US010913469B2

(12) United States Patent
Woods

(10) Patent No.: US 10,913,469 B2
(45) Date of Patent: Feb. 9, 2021

(54) RAILROAD CAR TRUCK BOLSTER

(71) Applicant: Standard Car Truck Company, Rosemont, IL (US)

(72) Inventor: Benjamin T. Woods, Lockport, IL (US)

(73) Assignee: STANDARD CAR TRUCK COMPANY, Rosemont, IL (US)

( * ) Notice: Subject to any disclaimer, the term of this patent is extended or adjusted under 35 U.S.C. 154(b) by 230 days.

(21) Appl. No.: 16/170,267

(22) Filed: Oct. 25, 2018

(65) Prior Publication Data

US 2019/0185032 A1 Jun. 20, 2019

Related U.S. Application Data

(60) Provisional application No. 62/607,051, filed on Dec. 18, 2017.

(51) Int. Cl.
*B61F 5/38* (2006.01)
*B61F 5/52* (2006.01)

(52) U.S. Cl.
CPC . *B61F 5/38* (2013.01); *B61F 5/52* (2013.01)

(58) Field of Classification Search
CPC ..... B61F 5/04; B61F 5/38; B61F 5/26; B61F 5/383; B61F 5/386; B61F 5/40; B61F 5/52; B61F 5/12; B61F 5/16; B61F 5/50; B61F 1/00
See application file for complete search history.

(56) References Cited

U.S. PATENT DOCUMENTS 2,065,454 A * 12/1936 Hammerstrom ..... B61F 5/04 105/226
2,161,513 A * 6/1939 Hammerstrom ..... B61F 5/04 105/226

(Continued)

FOREIGN PATENT DOCUMENTS

WO 2008070953 A1 6/2008

OTHER PUBLICATIONS

"International Search Report and Written Opinion", Korean Intellectual Property Office, Application No. PCT/US2018/064884 (15 pages) dated Apr. 1, 2019.

(Continued)

*Primary Examiner* — Jason C Smith
(74) *Attorney, Agent, or Firm* — McCoy Russell LLP

(57) ABSTRACT

A railroad car truck bolster including a first end, a first diagonal member, a transitional concave first turn of spring seat, a center rib assembly, first and second diagonal ribs, and a bottom member. The center rib assembly includes first, second, and third center ribs and a U transition. The bottom member includes thickened walls that define brake rod holes. The first diagonal member is connected to the first end via the concave first turn of spring seat. The center rib assembly is connected to the first end, the straight first diagonal member, and the first turn of spring seat. The first, second, and third center ribs are connected to one another via the U transition. The first and second diagonal ribs are connected to the first turn of spring seat. The third center rib is between the first and second diagonal ribs. The bottom member is connected to the first diagonal member.

28 Claims, 16 Drawing Sheets

(56) References Cited

U.S. PATENT DOCUMENTS

| | | | | | |
|---|---|---|---|---|---|
| 2,392,292 | A * | 1/1946 | Nystrom | B61F 5/04 | 105/229 |
| 2,400,550 | A * | 5/1946 | Hickman | B61F 5/12 | 105/197.1 |
| 4,187,600 | A * | 2/1980 | Yeates | B23C 3/00 | 29/564 |
| 4,196,672 | A * | 4/1980 | Bullock | B61F 5/04 | 105/226 |
| 4,311,098 | A * | 1/1982 | Irwin | B61F 5/16 | 105/226 |
| 4,342,266 | A * | 8/1982 | Cooley | B61F 5/52 | 105/226 |
| 4,357,880 | A * | 11/1982 | Weber | B61F 5/122 | 105/206.1 |
| 4,363,276 | A * | 12/1982 | Neumann | B61F 5/52 | 105/198.2 |
| 5,111,753 | A * | 5/1992 | Zigler | B61F 5/04 | 105/230 |
| 5,241,913 | A * | 9/1993 | Weber | B61F 5/00 | 105/208 |
| 6,089,166 | A * | 7/2000 | Callahan | B22C 9/22 | 105/226 |
| 6,196,134 | B1 * | 3/2001 | Stecker | B61F 5/04 | 105/226 |
| 6,354,226 | B2 | 3/2002 | Stecker | | |
| 6,622,776 | B2 | 9/2003 | Bauer et al. | | |
| 7,631,603 | B2 * | 12/2009 | Forbes | B61F 5/32 | 105/157.1 |
| 7,681,506 | B2 | 3/2010 | Forbes et al. | | |
| 7,823,513 | B2 * | 11/2010 | Forbes | B61F 5/38 | 105/193 |
| 7,946,229 | B2 | 5/2011 | Forbes et al. | | |
| 2001/0008108 | A1 | 7/2001 | Stecker | | |
| 2006/0283351 | A1 * | 12/2006 | Forbes | B61F 5/52 | 105/157.1 |
| 2019/0185032 | A1 * | 6/2019 | Woods | B61F 5/06 | |
| 2019/0359230 | A1 * | 11/2019 | Woods | B61F 5/301 | |

OTHER PUBLICATIONS

"Manual of Standards and Recommended Practices Section S Casting Details", The Association of American Railroads (15 pages) Nov. 1, 2016.

Standard Car Truck Company, "Stabilized Components Parts Diagram" available at http://www.sctco.com/products.html, prior to Dec. 18, 2017 (2 pages).

* cited by examiner

RAILROAD CAR TRUCK BOLSTER

PRIORITY CLAIM

This application claims priority to and the benefit of U.S. Provisional Patent Application No. 62/607,051, filed Dec. 18, 2017, the entire contents of which are incorporated herein by reference.

BACKGROUND

Conventional freight railroad cars in North America and other parts of the world typically include a car body and two spaced apart trucks. The car body or car body under frame typically includes two spaced apart center plates that respectively rest on and are rotatably received by bolster bowls of the two trucks. The trucks rollingly support the car body along railroad tracks or rails. Each truck typically has a three piece truck configuration that includes two spaced apart parallel side frames and a bolster. The side frames generally extend in the same direction as the tracks or rails, and the bolster generally extends transversely or laterally to the tracks or rails. The bolster extends laterally through and between and is supported by the two spaced apart side frames. Each side frame typically defines a center opening and pedestal jaw openings on each side of the center opening. Each end of each bolster is typically supported by a spring group positioned in the center opening of the side frame and supported by the lower portion of the side frame that defines the center opening.

Each truck also typically includes two axles that support the side frames, four wheels, and four roller bearing assemblies respectively mounted on the ends of the axles. The truck further typically includes four bearing adapters respectively positioned on each roller bearing assembly in the respective pedestal jaw opening below the downwardly facing wall of the side frame that defines the top of the pedestal jaw opening. The wheel sets of the truck are thus received in bearing adapters placed in leading and trailing pedestal jaws in the side frames, so that axles of the wheel sets are generally parallel. The bearing adapters permit relatively slight angular displacement of the axles. The spring sets or groups permit the bolster to move somewhat with respect to the side frame, about longitudinal or horizontal, vertical, and transverse axes (and combinations thereof).

Directions and orientations herein refer to the normal orientation of a railroad car in use. Thus, unless the context clearly requires otherwise, the "longitudinal" axis or direction is substantially parallel to straight tracks or rails and in the direction of movement of the railroad car on the track or rails in either direction. The "transverse" or "lateral" axis or direction is in a horizontal direction substantially perpendicular to the longitudinal axis and the straight tracks or rails. "Vertical" is the up-and-down direction, and "horizontal" is a plane parallel to the tracks or rails including the transverse and longitudinal axes. The "leading" side of the truck means the first side of a truck of a railroad car to encounter a turn; and the "trailing" side is opposite the leading side.

There is a continuing demand in the railroad industry to improve bolsters and side frames, and to reduce potential stress fractures or cracks in bolsters and side frames.

SUMMARY

Various embodiments of the present disclosure provide a new railroad car truck, and more particularly a new railroad car truck including a new bolster that includes one or more of a plurality of different improvements that individually and in various combinations reduce, inhibit, and/or minimize the likelihood of stress fractures or cracks in the bolster.

Various embodiments of the present disclosure also provide a new railroad car, and more particularly a new railroad car having a new railroad car truck including a new bolster that includes one or more of a plurality of different improvements that individually and in various combinations reduce the overall weight of the bolster and thus the railroad car truck and the railroad car. Such reduced weight increases fuel efficiency.

In various embodiments, the present disclosure provides an improved casted bolster for a freight railroad car truck configured to be employed in a freight railroad car truck and that includes one or more of a plurality of improvements that in combination reduce, inhibit, and/or minimize the likelihood of stress fractures or cracks in the bolster, and thus reduce maintenance expense and time out of service. These improvements also provide for an overall lighter bolster and truck making the freight railroad car more efficient. In various embodiments, the improved bolster generally includes: (a) a first end; (b) a first diagonal member connected to the first end via a transitional concave first turn of spring seat; (c) a center rib assembly connected to the first end, to the straight first diagonal member, and to the first turn of spring seat and comprising: (i) a first center rib; (ii) a second center rib connected to the first center rib via a first U transition; and (iii) a third center rib connected to the first and second center ribs via the first U transition; (d) a first diagonal rib connected to the first turn of spring seat adjacent the third center rib; (e) a second diagonal rib connected to the first turn of spring seat adjacent the third center rib, the third center rib being between the first and second diagonal ribs; and (f) a bottom member connected to the first diagonal member and having thickened walls (or beadings) that respectively form the brake rod holes. The improved bolster generally also includes: (a) a second end; (b) a second diagonal member connected to the second end via a transitional concave second turn of spring seat; (c) a second center rib assembly connected to the second end, to the straight second diagonal member, and to the second turn of spring seat and comprising a fourth center rib connected to the first and second center ribs via a second U transition; (d) a third diagonal rib connected to the second turn of spring seat adjacent the fourth center rib; and (e) a fourth diagonal rib connected to the second turn of spring seat adjacent the fourth center rib, the fourth center rib being between the third and fourth diagonal ribs.

In various embodiments, the present disclosure provides a railroad car truck including a first side frame, a second side frame, and this improved bolster supported by the first frame and the second frame. In various embodiments, the present disclosure provides a railroad car including one or more such railroad car trucks.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1:
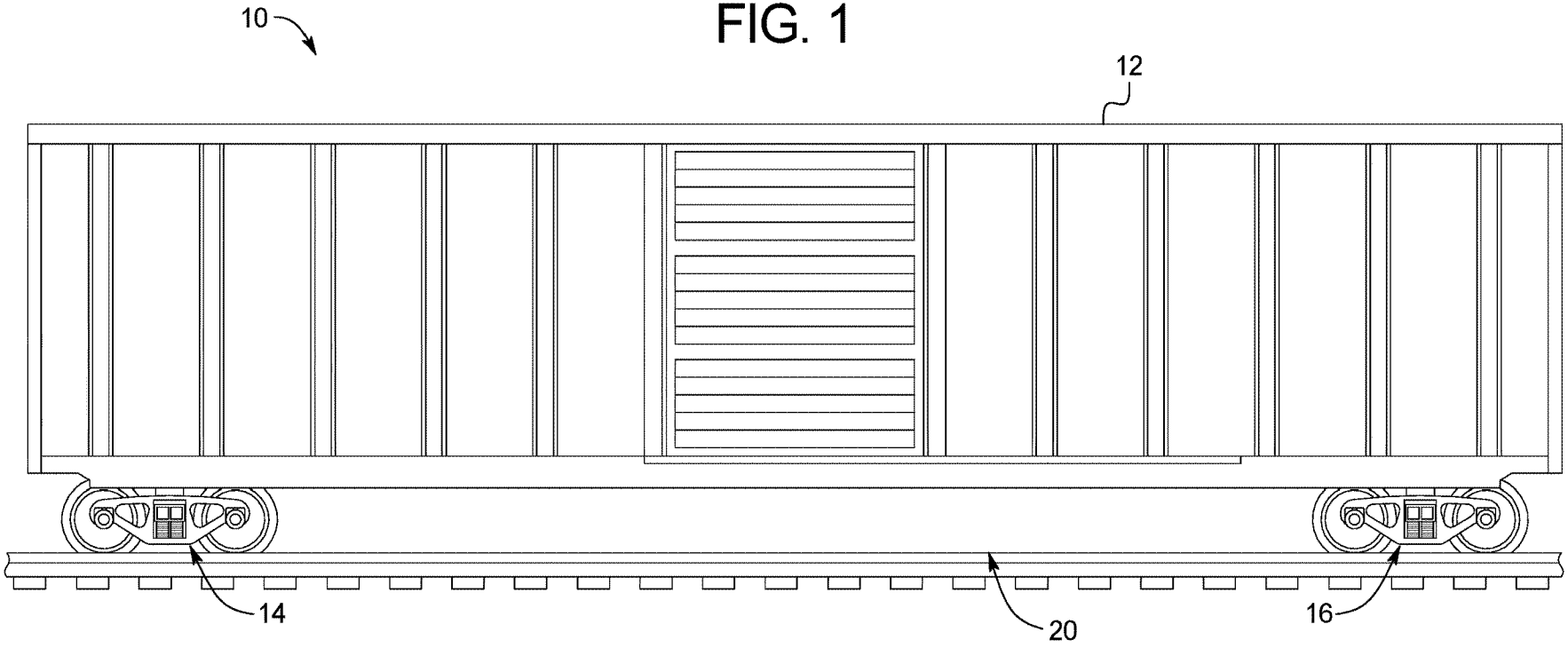
FIG. 1 is a side view of an example freight railroad car of the present disclosure positioned on conventional railroad tracks.

Various embodiments of the present disclosure provide a new bolster for a railroad car truck and a new railroad car truck having the new holster, and a new railroad car having at least one new truck with the new bolster. It should be appreciated that the bolster of the present disclosure can be used in connection with any suitable transportation device (such as freight railroad cars).

Referring now to the drawings, FIGS. 1 to 13 illustrate one example embodiment of such a new railroad car, a new railroad car truck, and a new railroad car truck bolster of the present disclosure, wherein the new bolster is generally indicated by numeral 100. In this illustrated example embodiment, the bolster 100 is included in an example freight railroad car 10 configured to be positioned on conventional railroad tracks 20. The freight railroad car 10 generally includes a car body 12, a first truck 14, and a second truck 16. It should be understood that the first truck 14 and the second truck 16 are identical or substantially identical in this illustrated example embodiment. Each of the first truck 14 and the second truck 16 includes an identical or substantially identical bolster 100. The railroad car 10 is configured to roll along the tracks 20 via the first truck 14 and the second truck 16 in a conventional manner. The car body 12 rotatably rests on the first truck 14 and the second truck 16 via the bolsters 100 in a conventional manner to navigate (e.g., accommodate, traverse, etc.) curves in the tracks 20.

Figure 2:
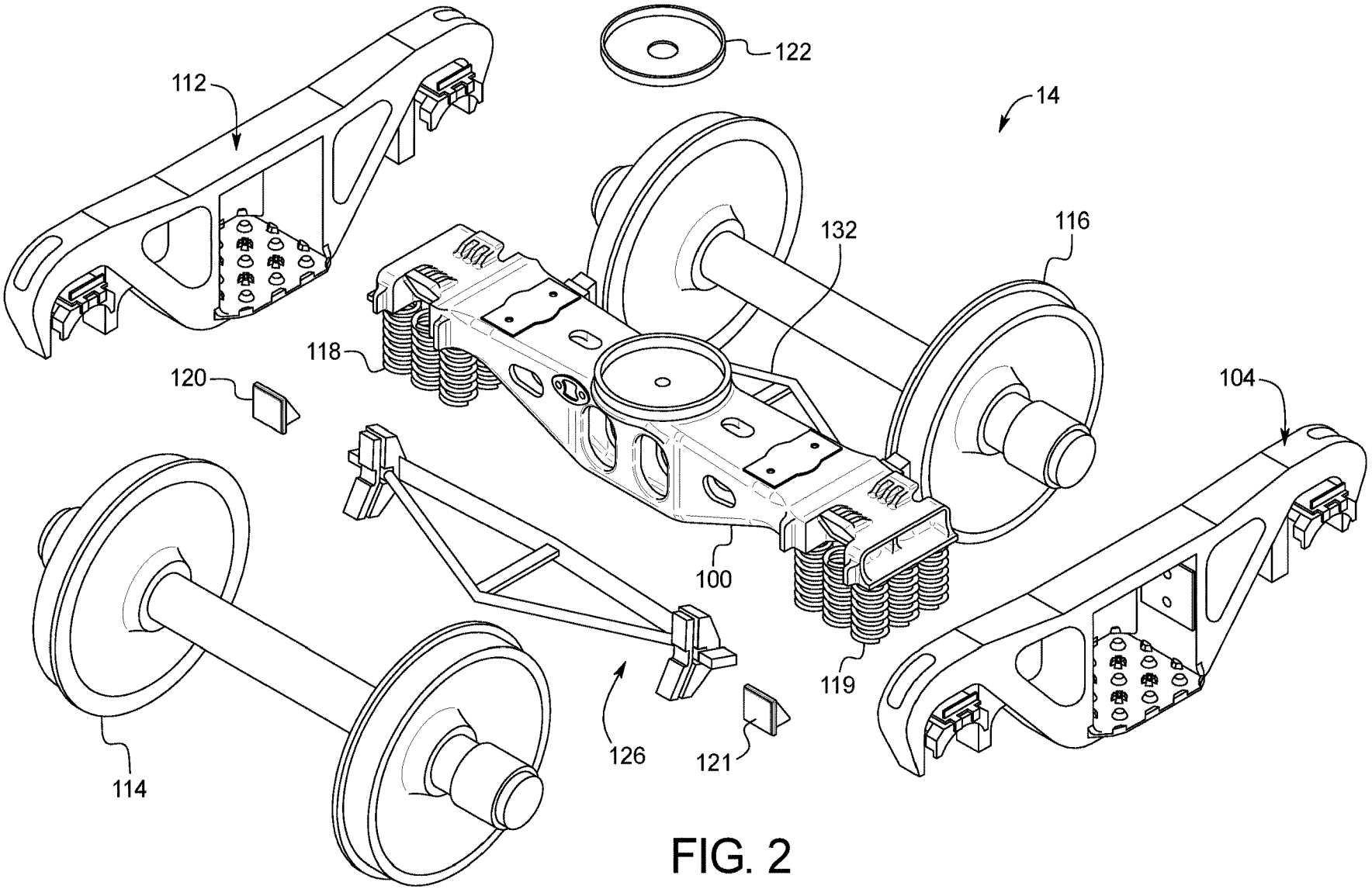
FIG. 2 is an exploded view of certain of the components of an example truck of an example freight railroad car of FIG. 1 which includes one example embodiment of the bolster of the present disclosure.

More specifically, in this illustrated example embodiment, the first truck 14 (as shown in FIG. 2) includes among many conventional components (not shown or described): a first side frame 104, a second side frame 112, a first rolling assembly 114, a second rolling assembly 116, first springs 118, second springs 119, first and second friction wedges 120 and 121, a bolster bowl wear liner 122, and a brake assembly 126 configured to co-act with the bolster 100 in a conventional manner.

In this illustrated example embodiment, the bolster 100 is configured to be partly positioned in the first side frame 104 and in the second side frame 112, and is resiliently supported by the first side frame 104 and by the second side frame 112 via the springs 118 and 119 in a conventional manner.

In this illustrated example embodiment, when the first truck 14 is assembled, the bolster bowl wear liner 122 is positioned in the bowl of the bolster 100. The first truck 14 and the second truck 16 are rotatably engaged with the car body 12 (as generally shown in FIG. 1) via the bolster bowl wear liners 122.

In operation of this illustrated example embodiment, the first side frame 104 and the second side frame 112 extend generally longitudinally in the same direction as the tracks 20 of FIG. 1. Thus, the bolster 100 extends generally transversely to the direction of (e.g., across) the railroad tracks 20 (as generally shown in FIG. 1).

As shown in more detail in FIGS. 3 to 13, the example bolster 100 generally includes: (a) a top member 200, (b) a first end 300, (c) a second end 350, (d) a bottom member 400, (e) a first diagonal member 500, (f) a second diagonal member 550, (g) a first transition curve 510, (h) a second transition curve 560, (i) a first turn of spring seat 520, (j) a second turn of spring seat 570, (k) a center rib assembly 600, (l) a first diagonal rib 686, and (m) a second diagonal rib 688. The example bolster 100 further includes a third diagonal rib (not shown) and a fourth diagonal rib (not shown). It should be understood that the top member 200, the first end 300, the second end 350, the bottom member 400, the first diagonal member 500, the second diagonal member 550, the center rib assembly 600, the first diagonal rib 686, the second diagonal rib 688, the third diagonal rib, and the fourth diagonal rib are formed monolithically together and integrally connected to one another during a suitable casting process in this illustrated example embodiment. Thus, the bolster 100 is a single, integral, unitary structure in this illustrated example embodiment.

The illustrated example embodiment of the bolster 100 of the present disclosure includes the following combination of four specific sets of improvements including: (a) the first end 300 transitioning to the first diagonal member 500 via a concave first turn of spring seat 520 and the second end 350 transitioning to the second diagonal member 550 via a concave second turn of spring seat 570; (b) the center rib assembly 600 having a first center rib 602 and a second center rib 624 that transition into a third center rib 644 via a first U transition 658; (c) the bottom member 400 having thickened walls (or beadings) 412A and 412B that respectively form the brake rod holes 410A and 410B; and (d) the first diagonal rib 686 and the second diagonal rib 688 connecting the top member 200 to the first end 300, to the first turn of spring seat 520, and to the first diagonal member 500. The combination of these improvements substantially reduce, inhibit, and/or minimize potential stress fractures in the bolster 100 by adding supporting specific structures to the bolster 100 and/or by removing stress-concentrating areas to enable the loads to be distributed more evenly across the entire bolster.

More specifically, the top member 200 is integrally connected to the first end 300, the second end 350, the bottom member 400, the first diagonal member 500, the second diagonal member 550, the center rib assembly 600, the first diagonal rib 686, the second diagonal rib 688, the third diagonal rib, and the fourth diagonal rib.

Figure 3:
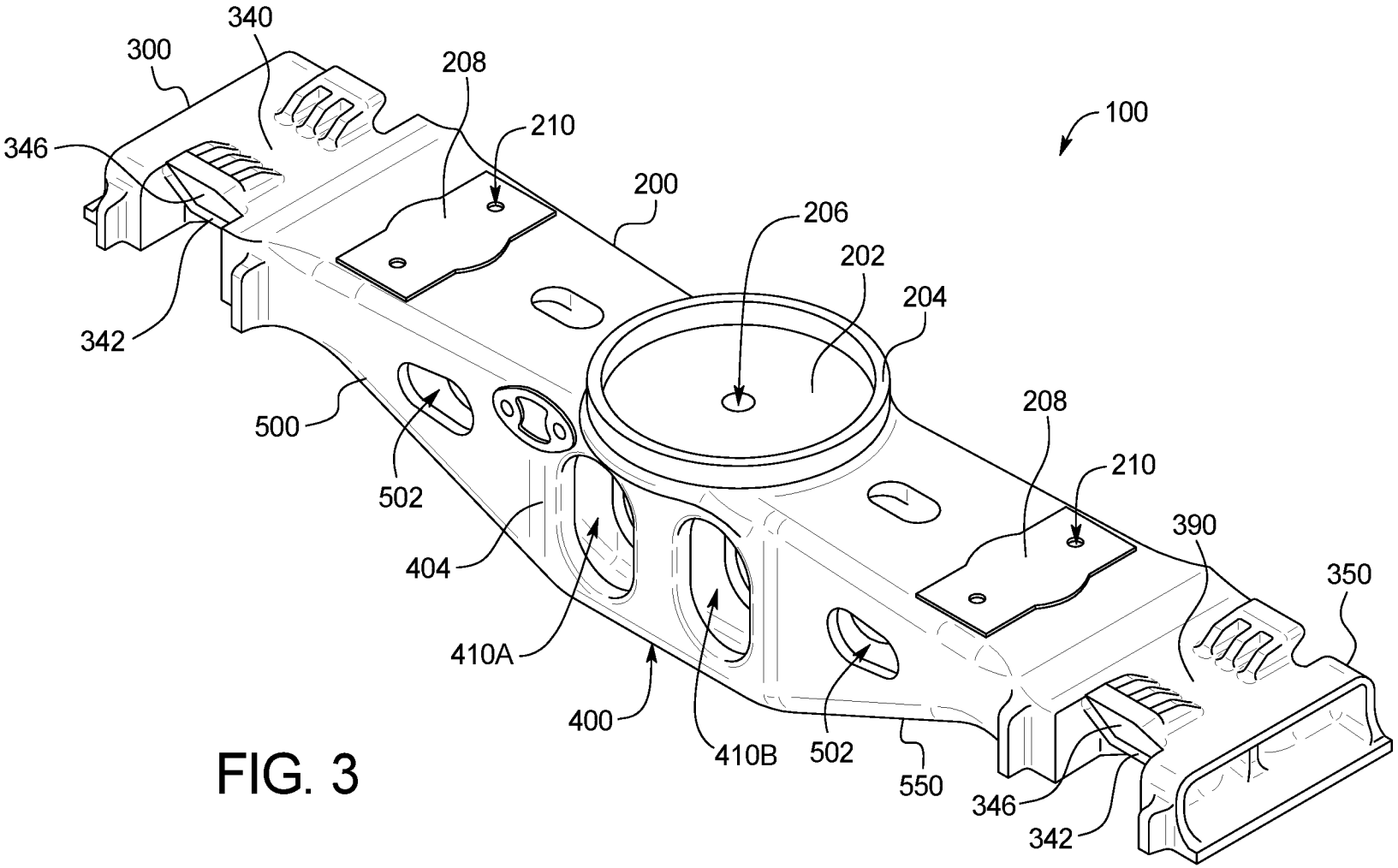
FIG. 3 is a perspective view of the example bolster of the truck of FIG. 2.
Figure 5:
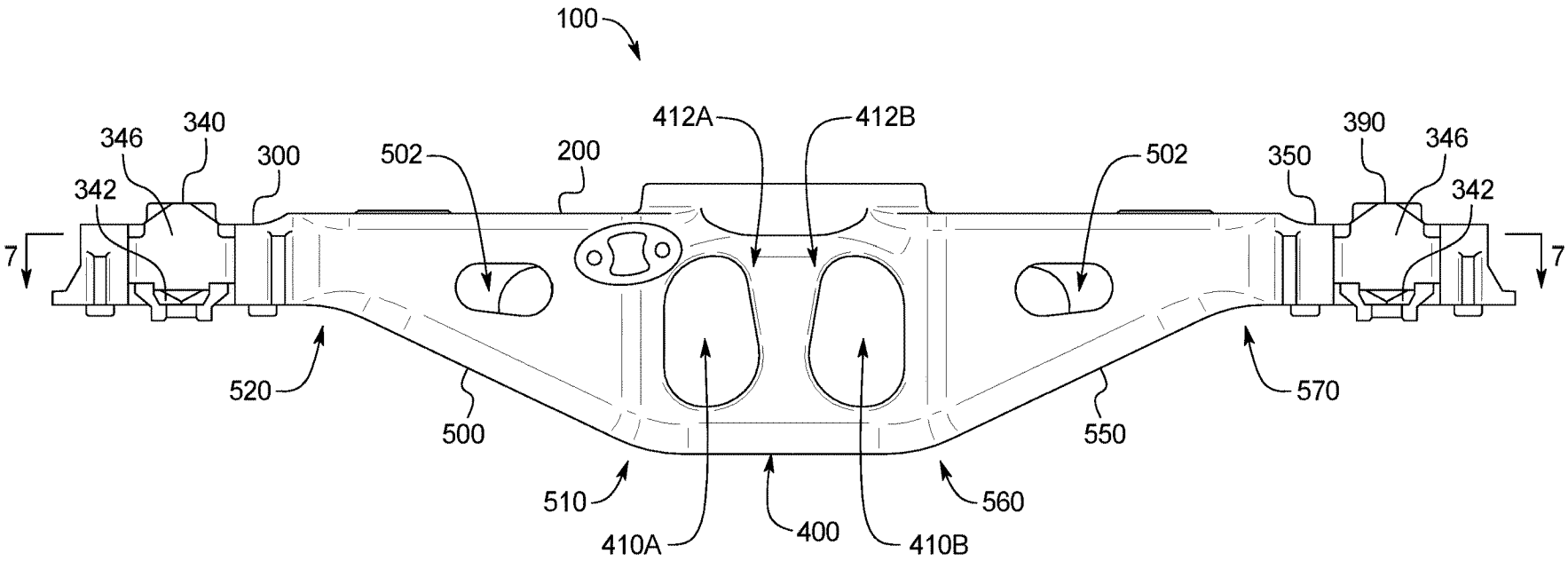
FIG. 5 is a side view of the bolster of FIG. 3.
Figure 6:
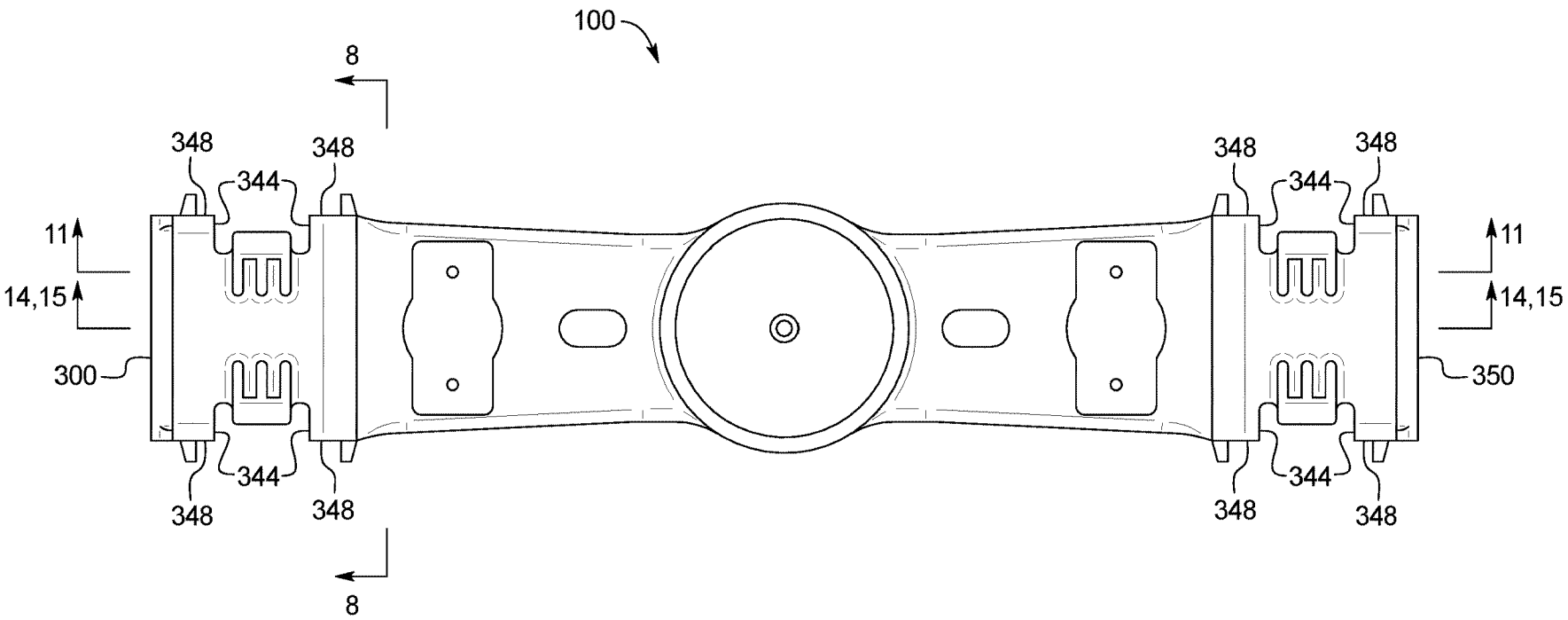
FIG. 6 is a top view of the bolster of FIG. 3.

The top member 200 includes a center plate bearing surface 202, a center plate rim 204, and side bearing pads 208 (as shown in FIGS. 3, 5, and 6). The top member 200 defines a king pin well 206 generally centrally located in the center plate bearing surface 202. The top member 200 defines a plurality of side bearing retainer holes 210 in the side bearing pads 208.

The first end 300 of the bolster 100 includes a first spring seat 310, a first column set 330, and a first bolster pocket 340 (as shown in FIGS. 3 to 8). Similarly, the second end 350 of the bolster 100 includes a second spring seat 360, a second column set 380, and a second bolster pocket 390 (as shown in FIGS. 3 to 8).

The first spring seat 310 and the second spring seat 360 include spring seat lugs 312. The spring seat lugs 312 are generally circular. The first spring seat 310 and the second spring seat 360 are configured to engage the springs 118 of FIG. 1.

The first column set 330 and the second column set 380 of the bolster 100 include outer column guides 332 and inner column guides 334. The first column set 330 and the second column set 380 are configured to engage column wear plates (not shown).

Figure 4:
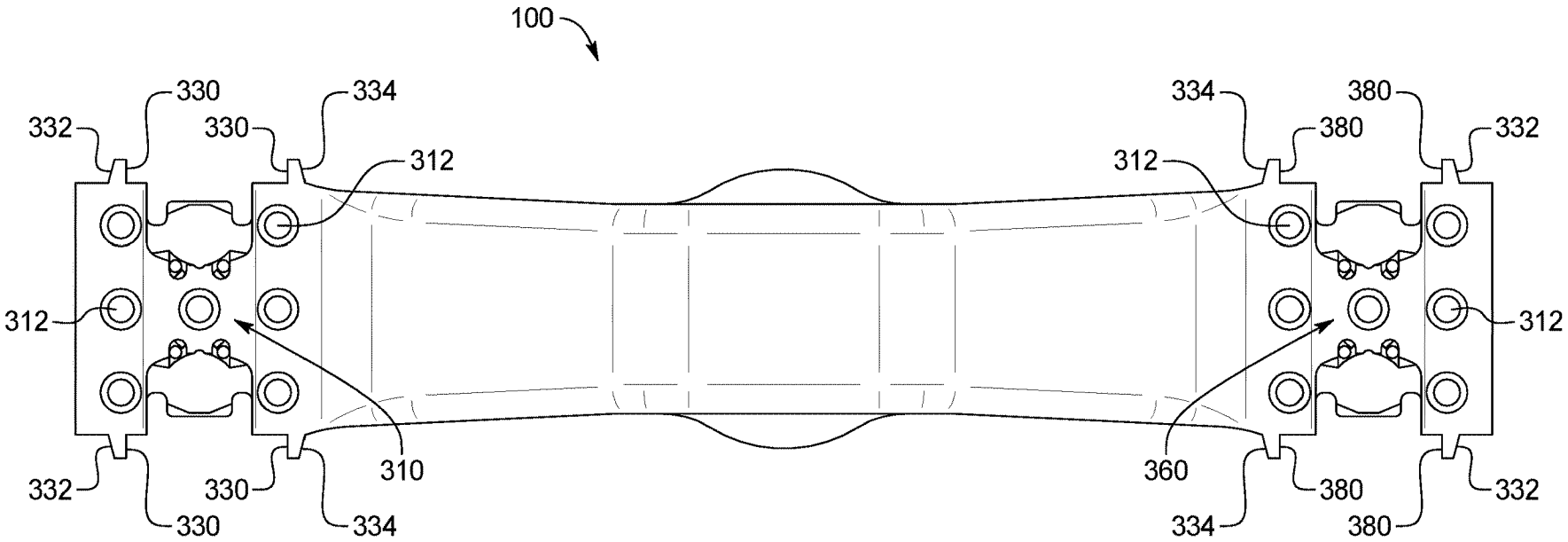
FIG. 4 is a bottom view of the bolster of FIG. 3.

The first bolster pocket 340 and the second bolster pocket 390 of the bolster 100 include bolster pocket sloped surfaces 342, bolster pocket side walls 344, bolster pocket wear plates 346, and lands 348. The bolster pocket wear plates 346 are connected to the bolster pocket sloped surfaces 342 (as shown in FIGS. 3 to 5).

The first diagonal member 500 is connected to the first end 300 via the first turn of spring seat 520. The first diagonal member 500 is connected to the bottom member 400 via the first transition curve 510. The first diagonal member 500 is substantially straight. In other words, the first diagonal member 500 in this illustrated example embodiment has no curves, inflection, or turns between the first turn of spring seat 520 and the first transition curve 510 (as shown in FIG. 5). The first turn of spring seat 520 is or includes a singular concave curve with no convex and/or re-curve features. In other words, the first turn of spring seat 520 arcs without inflection between the first end 300 and the first diagonal member 500 (as shown in FIGS. 3 and 5). The straight first diagonal member 500 meets the first end 300 by way of the concavely arcuate first turn of spring seat 520. Thus, a single angle is formed between the first diagonal member 500 and the first end 300 in this example embodiment. This configuration reduces, inhibits, and/or minimizes stress by more evenly distributing the stress in the first turn of spring seat 520 because the first turn of spring seat 520 is a single larger concave arc connecting the straight first diagonal member 500 with the first end 300.

Similarly, the second diagonal member 550 is connected to the second end 350 via the second turn of spring seat 570. The second diagonal member 550 is connected to the bottom member 400 via the second transition curve 560. The second diagonal member 550 is substantially straight. The second turn of spring seat 570 is a singular concave curve with no convex and/or re-curve features in this illustrated example embodiment. Thus, a single angle is formed between the second diagonal member 550 and the second end 350 in this example embodiment. This configuration reduces, inhibits, and/or minimizes stress by more evenly distributing stress in the second turn of spring seat 570 because the first turn of spring seat 570 is a single larger concave arc connecting the straight second diagonal member 550 with the second end 350.

The first diagonal member 500 and the second diagonal member 550 each define side wall lightener holes 502 (as shown in FIGS. 3 and 5).

Figure 7:
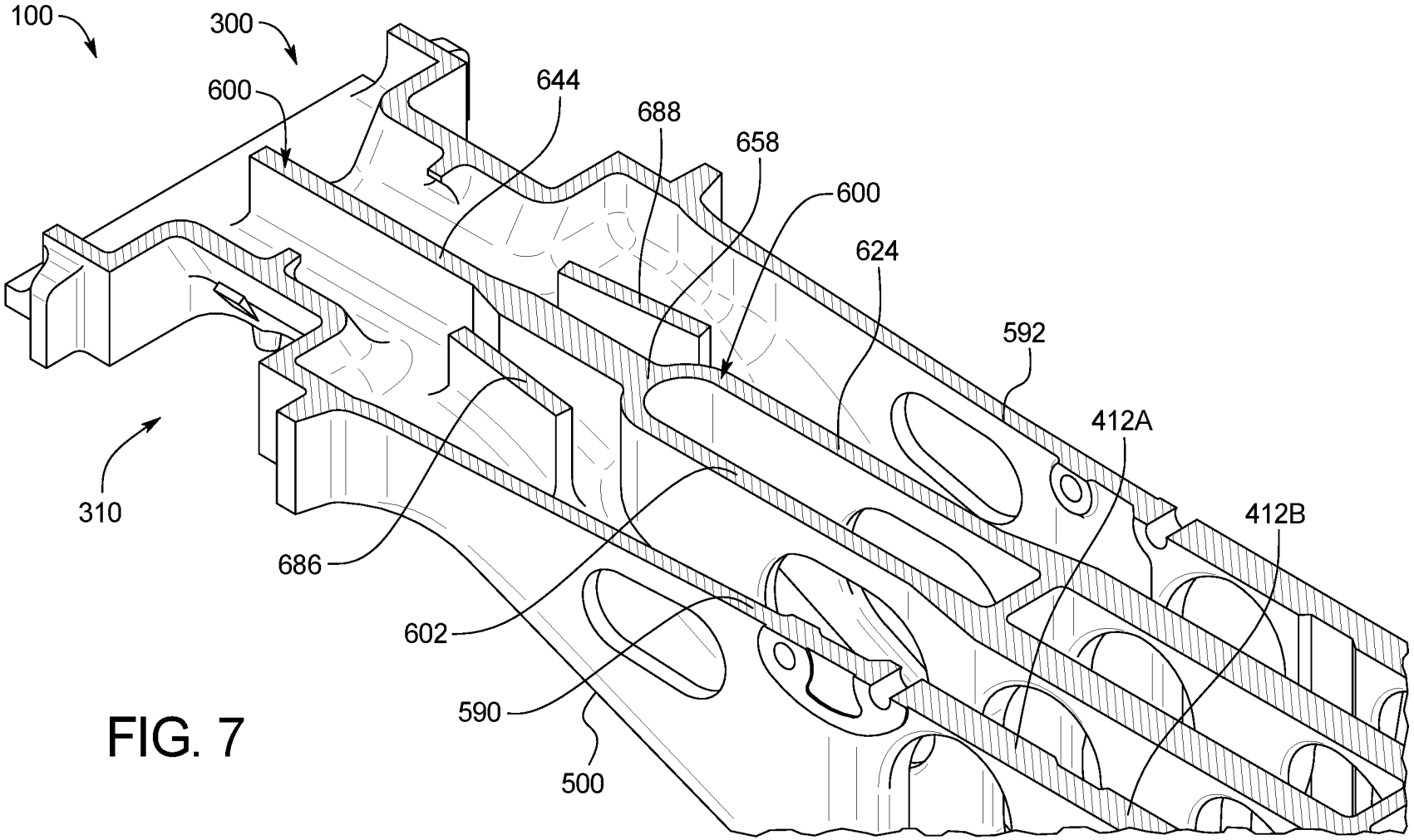
FIG. 7 is a fragmentary perspective cross-sectional view of an end of the bolster of FIG. 3 taken substantially along section line 7-7 of FIG. 5.

The center rib assembly 600 is disposed inside the bolster 100. As shown in FIG. 7, the center rib assembly 600 is connected to the first end 300, the first turn of spring seat 520, and the first diagonal member 500. It should be understood that the center rib assembly 600 extends through the bolster 100 and is connected to the top member 200, the first transition curve 510, the bottom member 400, the second transition curve 560, the second diagonal member 550, the second turn of spring seat 570, and the second end 350 (not shown). Thus, the top member 200 is additionally connected to the first end 300, the first diagonal member 500, the bottom member 400, the second diagonal member 550, and the second end 350 via the center rib assembly 600. The center rib assembly 600 provides increased stiffness to the bolster 100.

Figure 8:
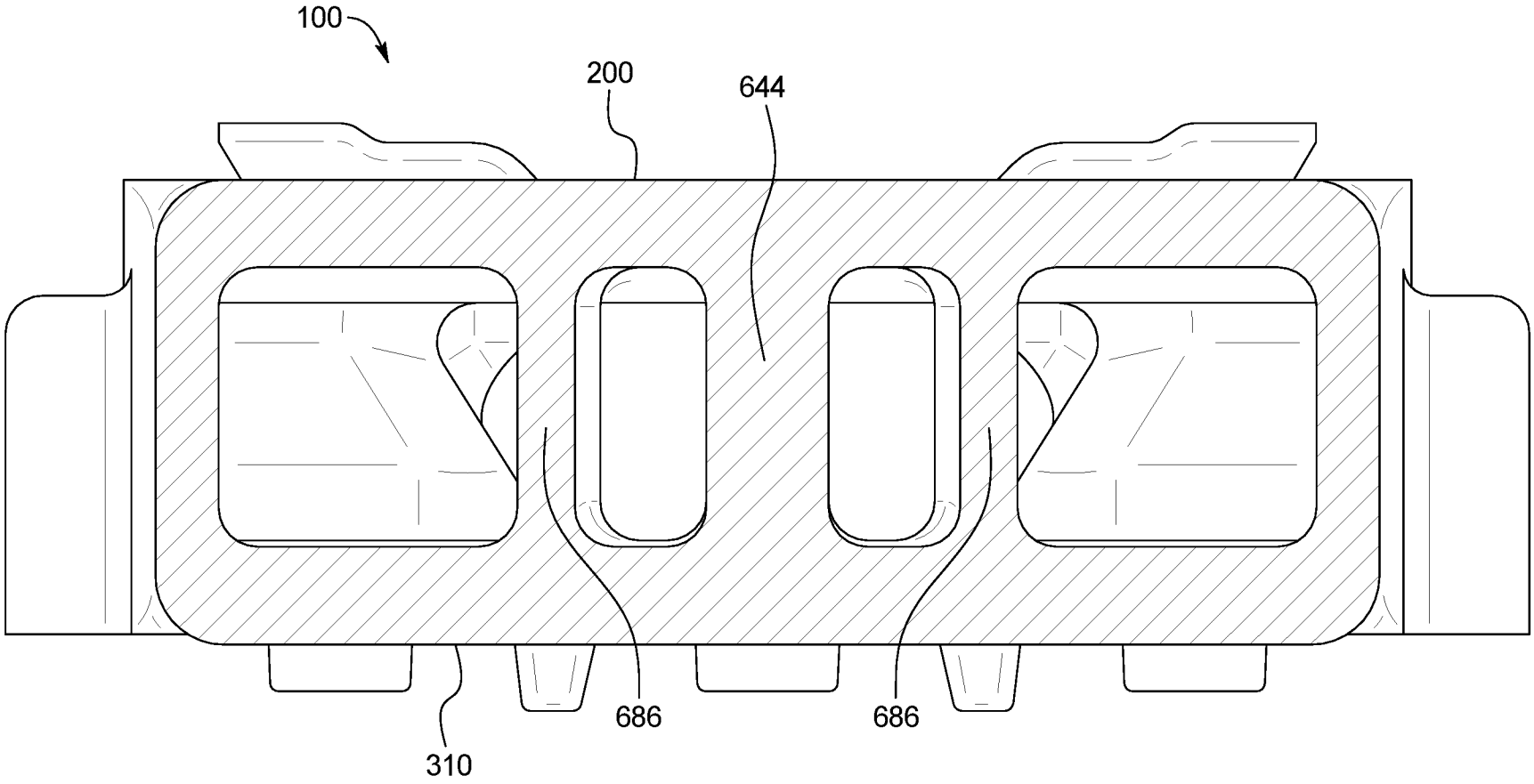
FIG. 8 is cross-sectional view of the bolster of FIG. 3 taken substantially along section line 8-8 of FIG. 6.
Figure 9:
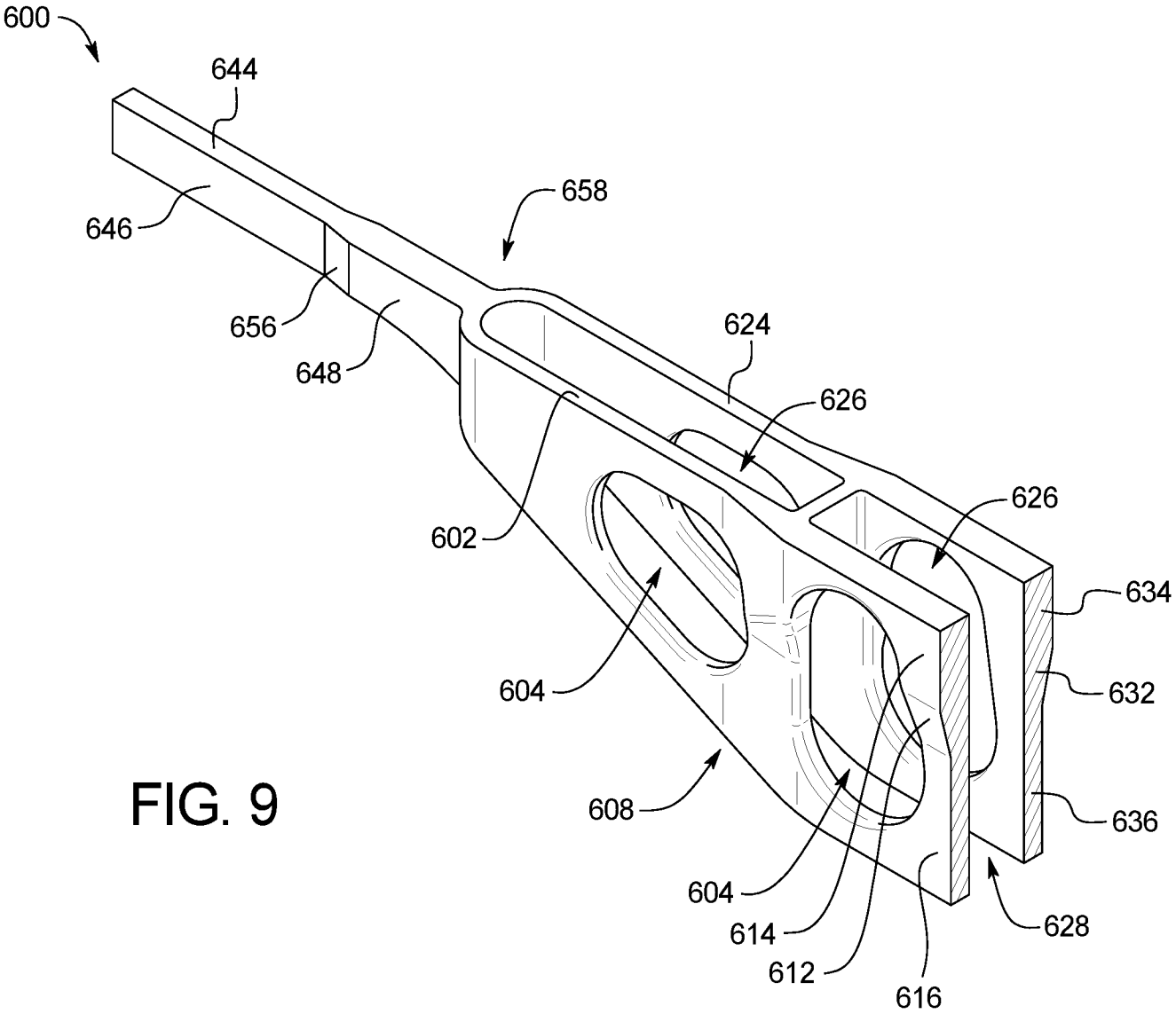
FIG. 9 is a fragmentary perspective view of a center rib assembly of the bolster of FIG. 3 shown removed from the bolster.
Figure 10:
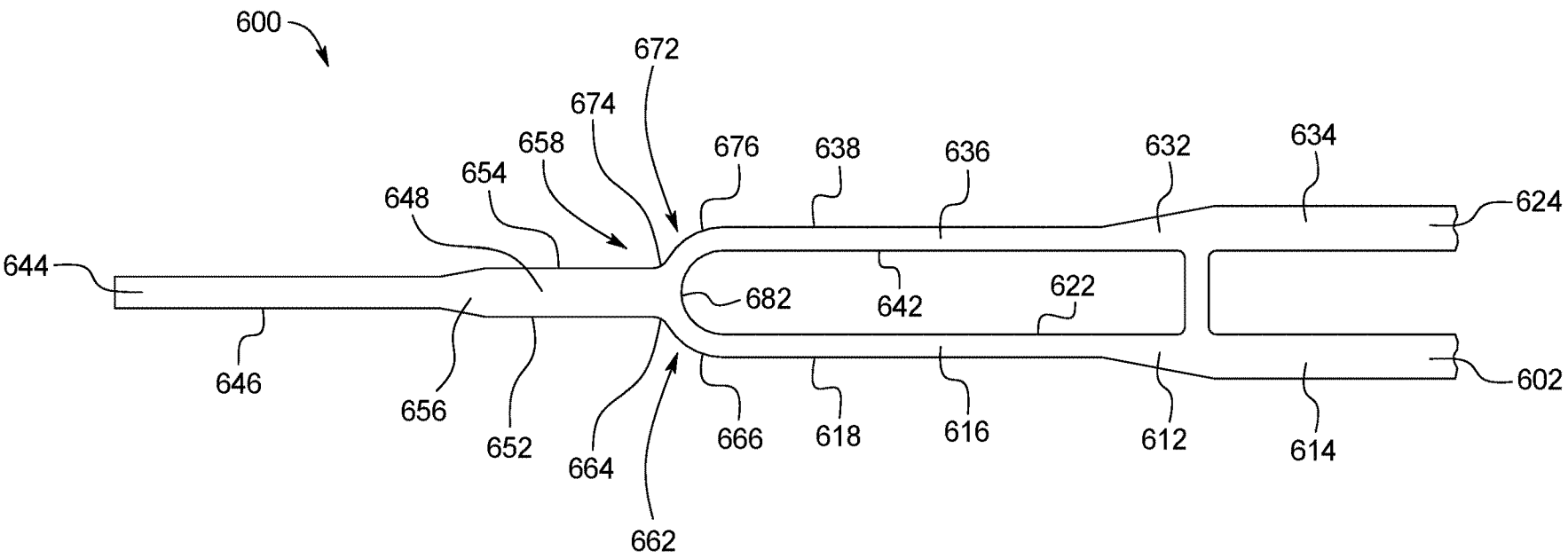
FIG. 10 is a fragmentary top view of the center rib assembly of FIG. 9.

The center rib assembly 600 includes the first center rib 602, the second center rib 624, the third center rib 644, and the first U transition 658 (as best shown in FIGS. 7, 8, 9, and 10). It should be understood that the center rib assembly 600 also includes a fourth center rib (not shown) and a second U transition (not shown) that respectively mirror the third center rib 644 and the first U transition 658. The first center rib 602 and the second center rib 624 transition into the third center rib 644 via the first U transition 658 (as best shown in FIGS. 7, 9, and 10). The U shape of the U transition 658 provides a smooth transition between the first center rib 602, the second center rib 624, and the third center rib 644. The smooth transition of the U transition 658 reduces, inhibits, and/or minimizes stresses in the first turn of spring seat 520 by strengthening the overall structure with one seamless center rib assembly running throughout the bolster. The single structure aids in removing concentrated stress areas specifically in the first turn of the spring seat 520 by taking on a larger portion of the load versus a typical known center rib assembly that is broken up in sections. Similarly, the second U transition (not shown) reduces, inhibits, and/or minimizes stresses in the second turn of spring seat 570.

The first center rib 602 includes: a first center rib lightening hole set 604, a first mating side 608, a first taper region 612, a first thick region 614, a first thin region 616, a first outer face 618, and a first inner face 622 (as best shown in FIGS. 7, 9, and 10). Similarly, the second center rib 624 includes: a second center rib lightening hole set 626, a second mating side 628, a second taper region 632, a second thick region 634, a second thin region 636, a second outer face 638, and a second inner face 642 (as best shown in FIGS. 7, 9, and 10). The first center rib 602 and the second center rib 624 respectively connect to the first diagonal member 500 via the first mating side 608 and the second mating side 628 (as shown in FIG. 7). The first center rib 602 and the second center rib 624 respectively connect the first transition curve 510, the bottom member 400, the second transition curve 560, and the second diagonal member 550 via the first mating side 608 and the second mating side 628 (not shown). The first thick region 614 transitions into the first thin region 616 via the first taper region 612. The second thick region 634 transitions into the second thin region 636 via the second taper region 632.

The third center rib 644 includes a first neck region 646, a second neck region 648, and a third taper region 656 (as best shown in FIGS. 9 and 10). The second neck region 648 includes a first side face 652 and a second side face 654 (as shown in FIG. 10). The first neck region 646 transitions into the second neck region 648 via the third taper region 656.

The first U transition 658 includes a first curved shoulder 662, a second curved shoulder 672, and an inner curve 682 (as shown in FIG. 10). The first curved shoulder 662 includes a first concave curve 664 and a first convex curve 666. Similarly, the second curved shoulder 672 includes a second concave curve 674 and a second convex curve 676.

The first center rib 602 transitions into the third center rib 644 via the first curved shoulder 662. Similarly, the second center rib 624 transitions into the third center rib 644 via the second curved shoulder 672. Further, the first center rib 602 and the second center rib 624 transition into one another via the first curved shoulder 662 and the second curved shoulder 672. The first center rib 602 and the second center rib 624 are substantially parallel (as shown in FIG. 10). Thus, the first center rib 602, the second center rib 624, the first curved shoulder 662, and the second curved shoulder 672 collectively form the first U shape of the first U transition 658. The third center rib 644 extends outwardly from the first U transition 658 and is substantially parallel with the first center rib 602 and with the second center rib 624 (as best shown in FIGS. 7, 9, and 10). In other words, the first center rib 602 and the second center rib 624 extend away from the first U transition 658 in a first direction 692 while the third center rib 644 extends away from the first U transition 658 in a second direction 694 opposite the first direction 692 (as shown in FIG. 10).

The first inner face 622 transitions into the second inner face 642 via the inner curve 682 (as shown in FIG. 10). The first outer face 618 transitions into the first side face 652 via the first convex curve 666 and the first concave curve 664. Similarly, the second outer face 638 transitions into the second side face 654 via the second convex curve 676 and the second concave curve 674.

Figure 11:
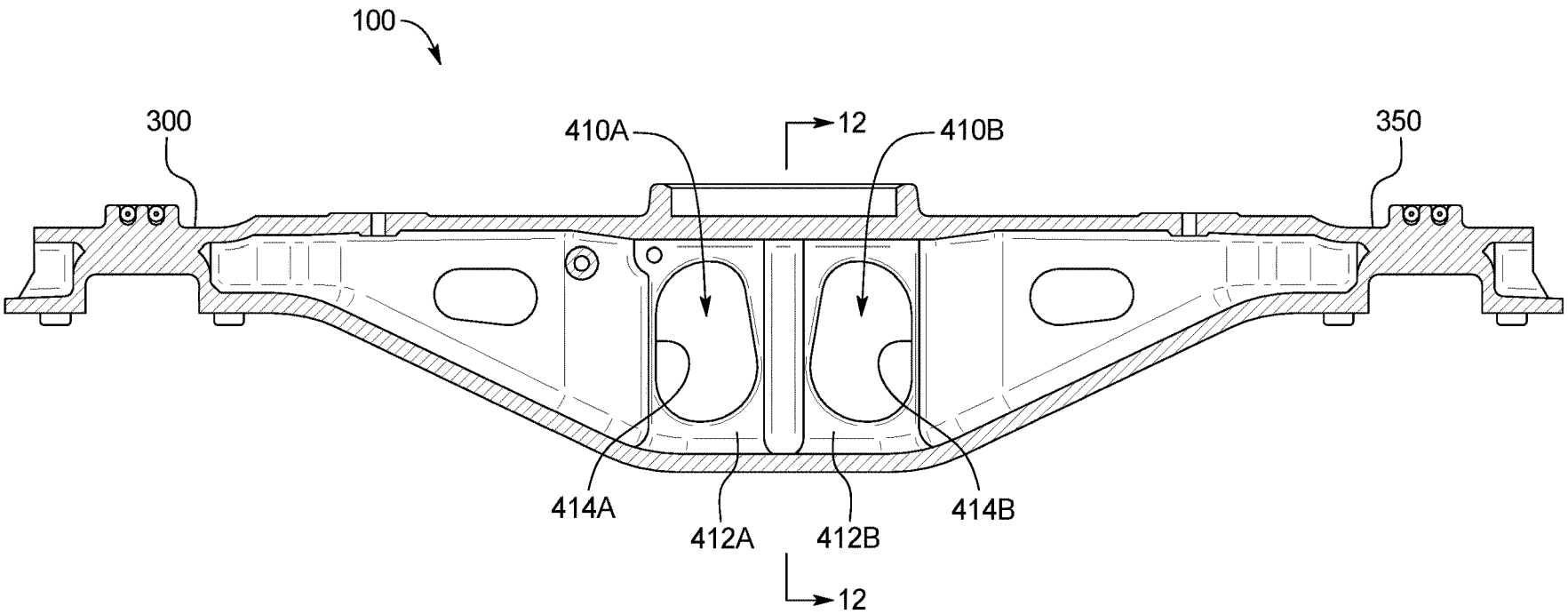
FIG. 11 is a cross-sectional view of the bolster of FIG. 3 taken substantially along section line 11-11 of FIG. 6.
Figure 12:
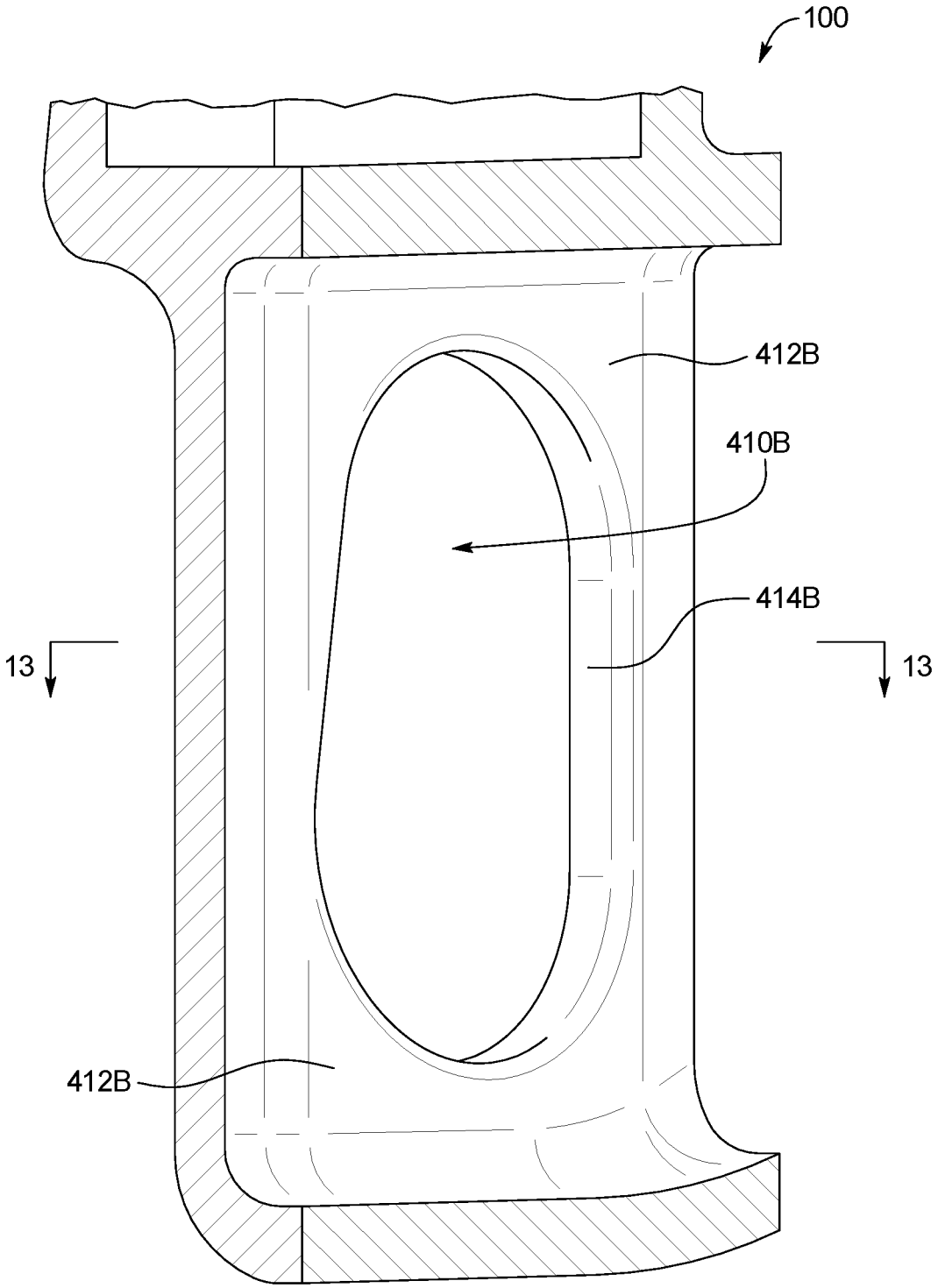
FIG. 12 is an enlarged fragmentary partial perspective and partial cross-sectional view of part of the bottom member of the bolster of FIG. 3 showing one of the thickened walls (or beadings) that forms one of the brake rod holes of the bolster of FIG. 3 and which is taken substantially along section line 12-12 of FIG. 6.
Figure 13:
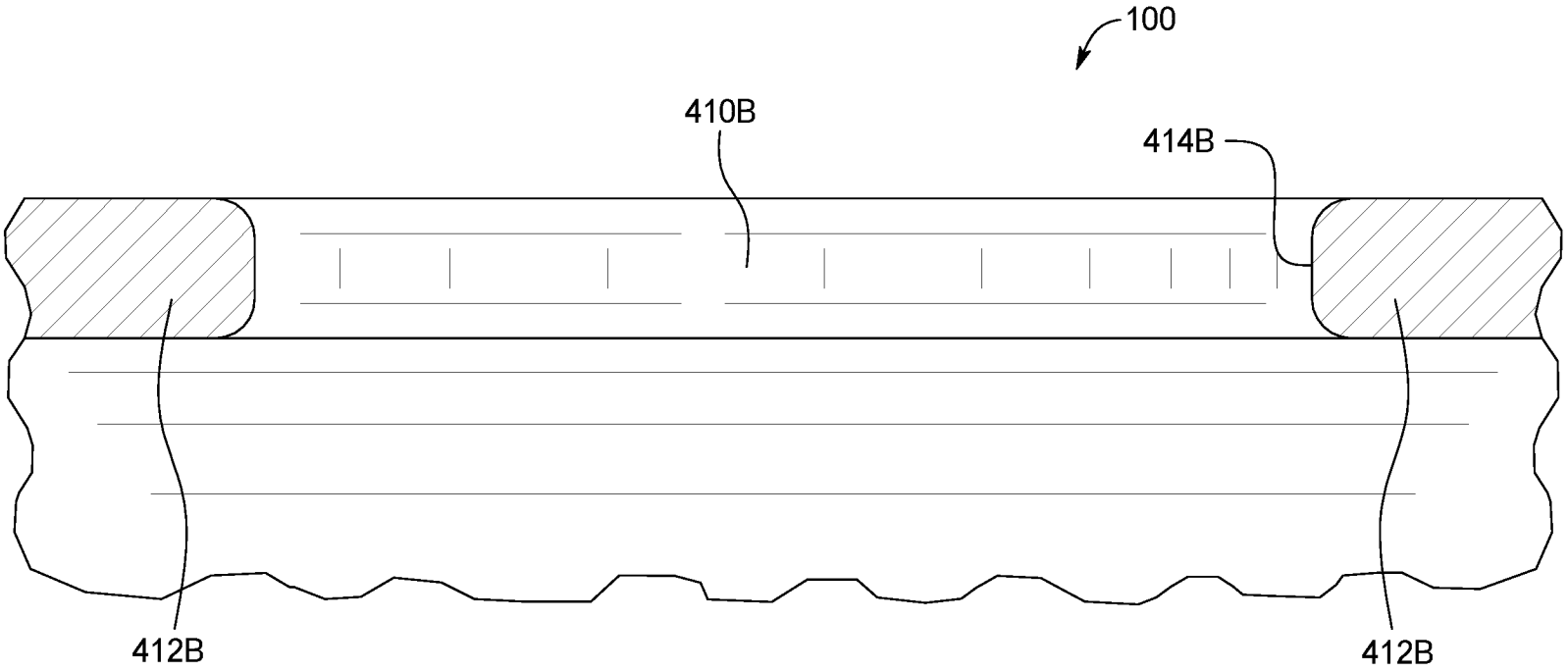
FIG. 13 is a fragmentary partial cross-sectional view of the bottom member of the bolster of FIG. 3 taken substantially along section line 13-13 of FIG. 12, and showing the bottom member having a thickened wall (or beading) that forms one of the brake rod holes.
Figure 16:
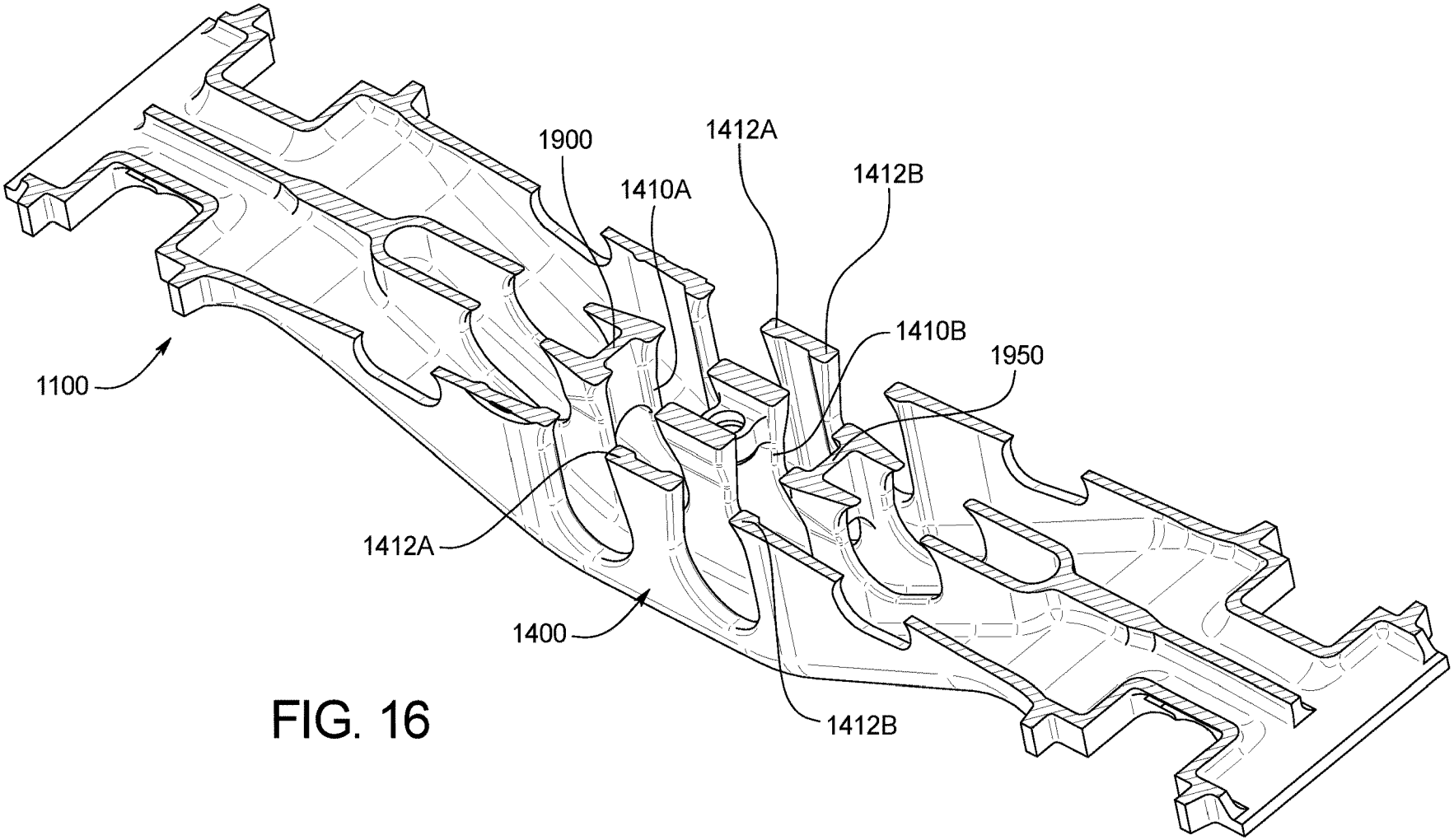
FIG. 16 is a cross-sectional view of the bolster of FIG. 14 taken substantially along line 16-16 of FIG. 15.

The bottom member 400 includes two thickened walls (or beadings) 412A and 412B that respectively form the brake rod holes 410A and 410B (as shown in FIGS. 3, 5, 11, 12, and 13). In other words, the brake rod holes 410A and 410B are defined in and by upstanding thickened walls (or beadings) 410A and 410B. As best seen in FIGS. 7, 11, and 16 (as described below), the thickened walls 412A and 412B are thicker than the adjacent walls that form the rest of the outer upstanding walls such as walls 590 and 592 of the bolster 100. More specifically, the thickened walls are 33 millimeters thick as compared to the adjacent non-thickened walls which are 25 millimeters thick. The additional material that forms the additional thickness is on the interior sections of those thickened walls. The thickened walls 412A and 412B include respective curvatures 414A and 414B that define the brake rod holes 410A and 410B (as shown in FIGS. 11, 12, and 13). The thickened walls (or beadings) 412A and 412B provide added strength and support for the entire bolster 100, for the areas under the bowl of the bolster 100, and for the areas that define the brake rod holes 410A and 410B. The thickened walls (or beadings) 412A and 412B thus reduce, inhibit and/or minimize stresses in the bottom member 400 of the bolster 100 in regions adjacent to the brake rod holes 410A and 410B that are prone to developing cracks during testing. The thickened walls (or beadings) 412A and 412B reduce, inhibit and/or minimize stresses by spreading stresses throughout the thickened walls (or beadings) 412A and 412B. As will be appreciated from the FIGS, this thickened wall feature is employed on both the front and back upstanding walls of the bolster 100.

The first diagonal rib 686 and the second diagonal rib 688 are disposed inside the bolster 100. The first diagonal rib 686 and the second diagonal rib 688 are connected to the first end 300, the first turn of spring seat 520, the first diagonal member 500, and the top member 200 (as shown in FIGS. 7 and 8). The first diagonal rib 686 and the second diagonal rib 688 are opposite one another adjacent to the third center rib 644 (as shown in FIGS. 7 and 8). In other words, the third center rib 644 is between the first diagonal rib 686 and the second diagonal rib 688. The first diagonal rib 686 and the second diagonal rib 688 are closer to one another nearer to the first end 300 than nearer to the first diagonal member 500 (as best shown in FIGS. 7 and 8). In other words, space between the first diagonal rib 686 and the second diagonal rib 688 is narrower adjacent the first end 300 than adjacent the first diagonal member 500. Thus, the first diagonal rib 686 and the second diagonal rib 688 form an acute angle with the third center rib 644 and with one another (as shown in FIG. 7). In certain embodiments, the first diagonal rib 686 and the second diagonal rib 688 each form an angle in the range of 5 to 10 degrees with the third center rib 644. Thus, in certain such examples, the first diagonal rib 686 and the second diagonal rib 688 form an angle in the range of 10 to 20 degrees with one another. It should be understood that the third diagonal rib (not shown) and the fourth diagonal rib (not shown) respectively mirror the first diagonal rib 686 and the second diagonal rib 688 to connect the second end 350, the second turn of spring seat 570, the second diagonal member 550, and the top member 200. The first diagonal rib 686 and the second diagonal rib 688 reduce, inhibit, and/or minimize stresses in the first turn of spring seat 520 by providing additional support to the first turn of spring seat 520 and while also providing for an overall lighter weight configuration. Similarly, the third diagonal rib and the fourth diagonal rib reduce, inhibit, and/or minimize stresses in the second turn of spring seat 570.

It should be appreciated that the example embodiment of the bolster 100 illustrated in the Figures employs one example configuration of components and one example size and shape of each of the components. It should be appreciated that other embodiments of the bolster may employ different configurations of the components and/or components of different sizes or shapes.

Figure 14:
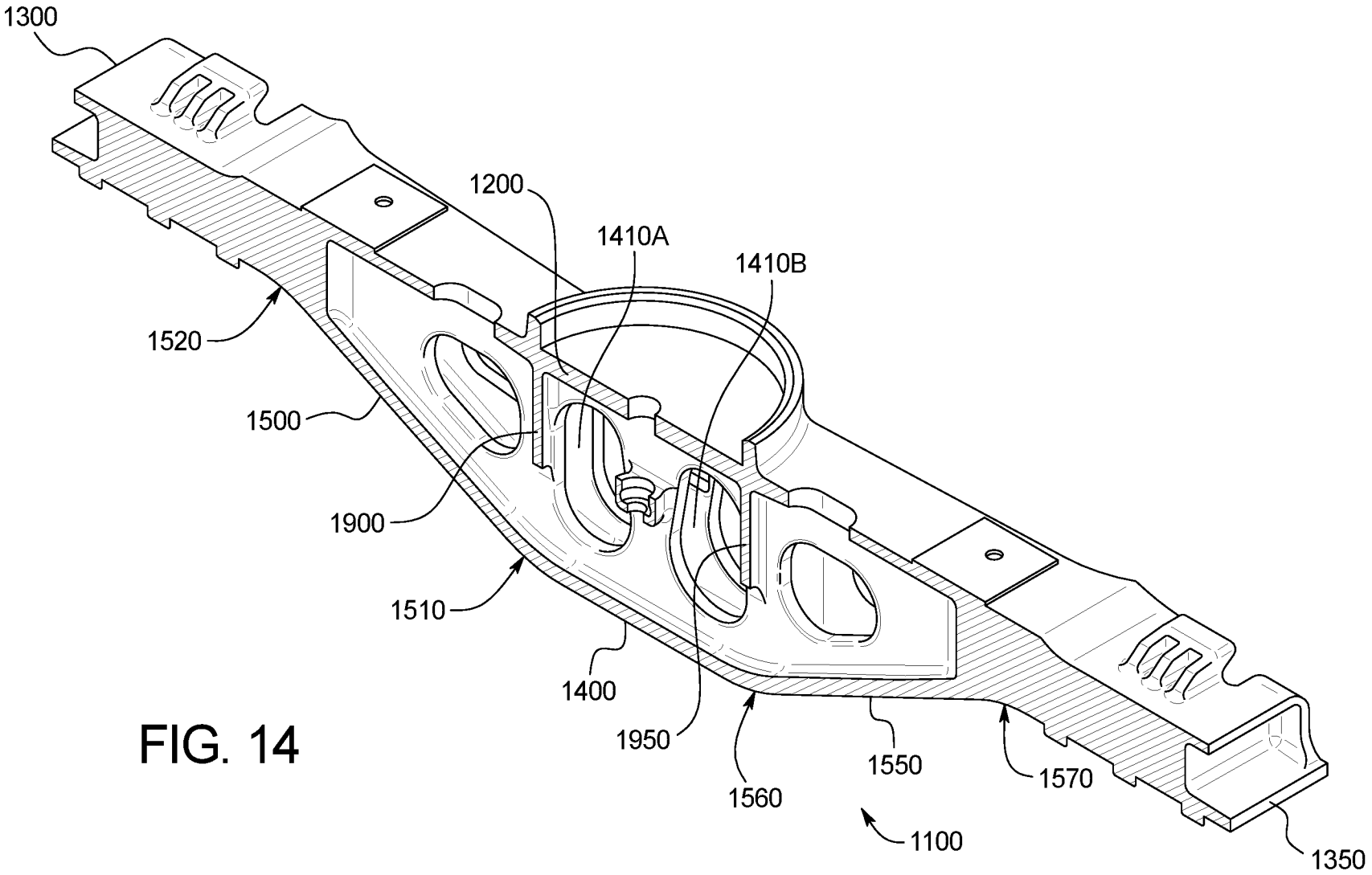
FIG. 14 is a cross-sectional perspective view of the bolster of an alternative example embodiment of the present disclosure.
Figure 15:
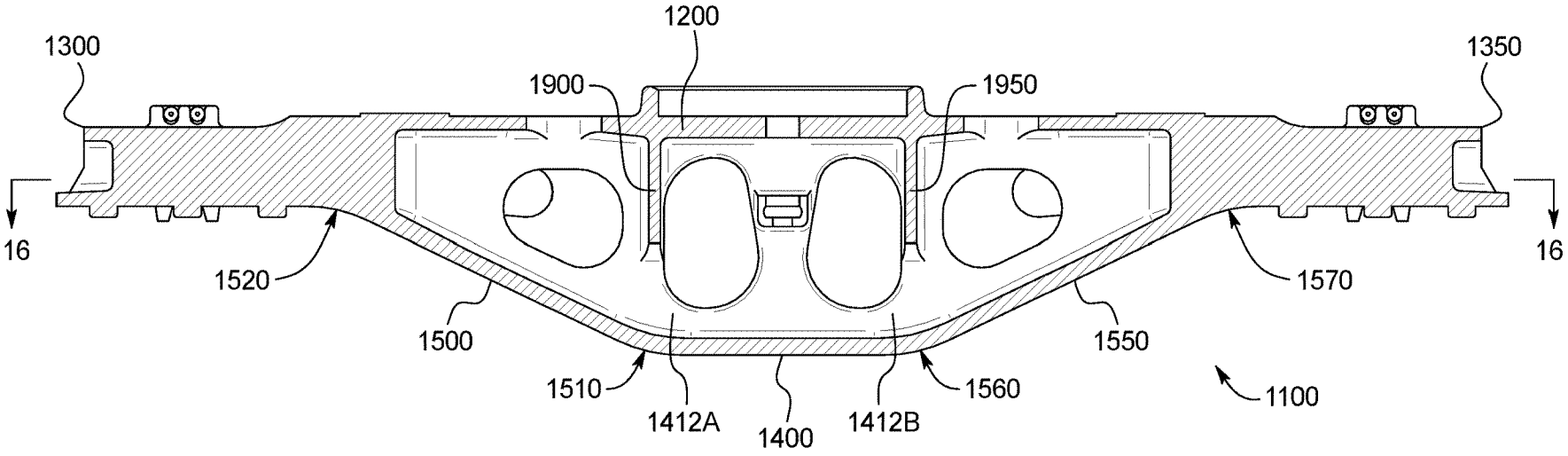
FIG. 15 is a cross-sectional view of the bolster of FIG. 14.

Referring now to FIGS. 14, 15, and 16, an alternative example embodiment of the bolster of the present disclosure is generally indicated by numeral 1100. As in the above illustrated example embodiment, the bolster 1100 is configured to be partly positioned in the first side frame 104 and in the second side frame 112, and is configured to be resiliently supported by the first side frame 104 and by the second side frame 112 via the springs 118 and 119 in a conventional manner (as generally indicated in FIG. 2). Likewise, in this illustrated example embodiment, when the first truck 14 is assembled: (a) the bolster bowl wear liner 122 is positioned in the bowl of the bolster 1100; (b) the first truck 14 and the second truck 16 are rotatably engaged with the car body 12 (as generally indicated in FIG. 1) via the bolster bowl wear liners 122; (c) the first side frame 104 and the second side frame 112 are configured to extend generally longitudinally in the same direction as the tracks 20; and (d) the bolster 1100 is configured to extend generally transversely to the direction of (e.g., across) the railroad tracks 20.

Like the illustrated example bolster 100, this example bolster 1100 generally includes: (a) a top member 1200; (b) a first end 1300; (c) a second end 1350; (d) a bottom member 1400; (e) a first diagonal member 1500; (f) a second diagonal member 1550; (g) a first transition curve 1510; (h) a second transition curve 1560; (i) a first turn of spring seat 1520; (j) a second turn of spring seat 1570; (k) a center rib assembly (not shown or labeled); (l) a first diagonal rib (not shown or labeled); and (m) a second diagonal rib (not shown or labeled). The example bolster 1100 further includes a third diagonal rib (not shown) and a fourth diagonal rib (not shown). Thus, this illustrated example embodiment includes all of the advantageous features of the example bolster 100 described above.

This illustrated example bolster 1100 further includes: (a) a first vertical or substantially vertical rib 1900 positioned adjacent to (such as approximately ⅜ inches outside of) the first interior brake rod hole or opening 1410A; and (b) a second vertical or substantially vertical rib 1950 positioned within adjacent to (such as approximately ⅜ inches outside of) the second interior brake rod hole or opening 1410B. In this illustrated example, (a) the first vertical or substantially vertical rib 1900 is integrally connected to and extends downwardly from the top member 1200; and (b) the second vertical or substantially vertical rib 1950 is integrally connected to and extends downwardly from the top member 1200.

More specifically, during center bowl rock loading, substantial weight of the car can be concentrated on or at one of the edges of the center bowl. This causes stress at the points of the bolster below such edges. By positioning the vertical ribs 1900 and 1950 respectively adjacent to the respective interior windows, these concentrated loading areas are better supported. This provides additional stress relief to the surfaces or walls that define the interior brake rod holes or openings 1410A and 1410B that can be prone to stress cracking.

It should be understood that the top member 1200, the first end 1300, the second end 1350, the bottom member 1400, the first diagonal member 1500, the second diagonal member 1550, the center rib assembly, the first diagonal rib, the second diagonal rib, the third diagonal rib, the fourth diagonal rib, the first rib 1900, and the second rib 1900 are monolithically formed together and integrally connected to one another during a suitable casting process in this illustrated example embodiment. Thus, the bolster 1100 is a single, integral, unitary structure in this illustrated example embodiment.

It should further be appreciated that this illustrated example embodiment of the bolster 1100 of the present disclosure thus includes the following combination of five specific sets of improvements including: (a) the first end 1300 transitioning to the first diagonal member 1500 via a concave first turn of spring seat 1520 and the second end 1350 transitioning to the second diagonal member 1550 via a concave second turn of spring seat 1570; (b) the center rib assembly 1600 having a first center rib and a second center rib that transition into a third center rib via a first U transition; (c) the bottom member 1400 including thickened walls 1412A and 1412B that respectively define the outer brake rod holes (not labeled); (d) the first diagonal rib and the second diagonal rib 1688 connecting the top member 1200 to the first end 1300, to the first turn of spring seat 1520, and to the first diagonal member 1500; and (e) the first rib 1900 and the second rib 1900. The combination of these improvements substantially reduce, inhibit and/or minimize potential stress fractures in the bolster 1100 by adding supporting specific structures to the bolster 1100 and/or by removing stress-concentrating areas to enable the loads to be distributed more evenly across the entire bolster.

It should also be appreciated from the above description, that each of the stress reducing features on their own reduce the amount of stress placed in certain critical areas on the bolster. In combination, the benefits are further increased. These combinations provide a new bolster configuration that enables the bolster to pass the new testing requirements to be imposed by the Association of American Railroads. Combinations of these components also enable an overall lighter weight bolster, lighter weight castings to enhance production, and lighter castings to enable the railroad cars to become more efficient.

It should also be appreciated that the present disclosure contemplates that any two or more of the five sets of stress reducing features can be employed together in a bolster without incorporating one or more of the other stress reducing features in various alternative embodiments of the present disclosure.

It should further be appreciated that the present disclosure contemplates that any one of the five sets of stress reducing features can be individually employed in a bolster without incorporating one or more of the other stress reducing features in various alternative embodiments of the present disclosure.

It should further be appreciated that the present disclosure provides an overall reduction in the weight of the bolster and thus the railroad car truck and the railroad car. Such reduced weight increases fuel efficiency.

It will be understood that modifications and variations may be effected without departing from the scope of the novel concepts of the present invention, and it is understood that this application is to be limited only by the scope of the claims.

The invention is claimed as follows:

1. A railroad car truck comprising:

a first side frame;

a second side frame; and a bolster supported by the first side frame and the second side frame, the bolster including:

a first end transitioning to a straight first diagonal member via a concave first turn of a spring seat;

a first diagonal rib connected to the first turn of the spring seat;

a second diagonal rib connected to the first turn of the spring seat;

a center rib assembly connected to the first end, to the straight first diagonal member, and to the first turn of the spring seat and having a first center rib, a second center rib, a third center rib, and a U transition, the first and second center ribs transitioning into the third center rib via the U transition, the third center rib being between the first and second diagonal ribs, wherein the U transition being immediately adjacent to the first, second, and third center ribs; and a bottom member that includes thickened walls that respectively define brake rod holes.

2. The railroad car truck of claim 1, wherein the first and second diagonal ribs are arranged diagonally with respect to the third center rib.

3. The railroad car truck of claim 2, wherein the first diagonal rib is arranged diagonally with respect to the second diagonal rib, the first diagonal rib being closer to second diagonal rib near the first end.

4. The railroad car truck of claim 1, which includes a top member connected to at least one of the center rib assembly, the first diagonal rib, and the second diagonal rib.

5. The railroad car truck of claim 1, wherein the U transition includes a first curved shoulder and a second curved shoulder, the first center rib extending from the from the first curved shoulder, the second center rib extending from the second curved shoulder.

6. The railroad car truck of claim 1, wherein the first center rib, the second center rib, and the third center rib are substantially parallel.

7. The railroad car truck of claim 1, wherein the thickened walls include respective curvatures that provide smooth transition between inner and outer surfaces of the thickened walls that define the brake rod holes.

8. The railroad car truck of claim 1, wherein the bolster further includes a vertical or substantially vertical rib positioned adjacent to one of the brake rod holes.

9. The railroad car truck of claim 1, wherein the first vertical or substantially vertical rib extends downwardly from a top member of the bolster.

10. A railroad car truck bolster comprising:
- a top member;
- a first end;
- a first diagonal member connected to the first end via a transitional concave first turn of spring seat;
- a center rib assembly connected to the first end, to the straight first diagonal member, and to the first turn of spring seat and comprising:
  - a first center rib;
  - a second center rib connected to the first center rib via a first U transition; and
  - a third center rib connected to the first and second center ribs via the first U transition, wherein the first U transition being immediately adjacent to the first, second, and third center ribs;
  - a first diagonal rib connected to the first turn of spring seat adjacent the third center rib;
  - a second diagonal rib connected to the first turn of spring seat adjacent the third center rib, the third center rib being between the first and second diagonal ribs; and
  - a bottom member connected to the first diagonal member, and including thickened walls that respectively define brake rod holes.

11. The railroad car truck bolster of claim 10, which includes:
- a second end;
- a second diagonal member connected to the second end via a transitional concave second turn of spring seat;
- a second center rib assembly connected to the second end, to the straight second diagonal member, and to the second turn of spring seat and comprising a fourth center rib connected to the first and second center ribs via a second U transition; and
- a third diagonal rib connected to the second turn of spring seat adjacent the fourth center rib; and
- a fourth diagonal rib connected to the second turn of spring seat adjacent the fourth center rib, the fourth center rib being between the third and fourth diagonal ribs.

12. The railroad car truck bolster of claim 11, which includes: (a) a first vertical or substantially vertical rib positioned adjacent to a first one of the brake rod holes; and (b) a second vertical or substantially vertical rib positioned adjacent to a second one of the brake rod holes.

13. The railroad car truck bolster of claim 12, wherein: (a) the first vertical or substantially vertical rib extends downwardly from the top member; and (b) the second vertical or substantially vertical rib extends downwardly from the top member.

14. The railroad car truck bolster of claim 10, wherein the first and second diagonal ribs are arranged diagonally with respect to the third center rib.

15. The railroad car truck of bolster of claim 14, wherein the first diagonal rib is arranged diagonally with respect to the second diagonal rib, the first diagonal rib being closer to second diagonal rib near the first end.

16. The railroad car truck bolster of claim 10, which includes a top member connected to at least one of the center rib assembly, the first diagonal rib, and the second diagonal rib.

17. The railroad car truck bolster of claim 10, wherein the first U transition comprises a first curved shoulder and a second curved shoulder, the first center rib extending from the from the first curved shoulder, the second center rib extending from the second curved shoulder.

18. The railroad car truck bolster of claim 10, wherein the first center rib, the second center rib, and the third center rib are substantially parallel.

19. The railroad car truck bolster of claim 10, wherein the thickened walls include respective curvatures that provide smooth transition between inner and outer surfaces of the thickened walls that define the brake rod holes.

20. A railroad car truck bolster comprising:
- a top member;
- a first center rib;
- a second center rib substantially parallel to the first center rib;
- a first U transition joining the first center rib to the second center rib;
- a third center rib extending outwardly from the first U transition, the U transition being immediately adjacent to the first, second, and third center ribs;
- a diagonal rib adjacent to the third center rib;
- a concave turn of spring seat connected to the diagonal rib;
- a straight diagonal member connected to the concave turn of spring seat; and
- a bottom member connected to the straight diagonal member, the bottom member including thickened walls include that respectively define brake rod holes.

21. The railroad car truck bolster of claim 20, wherein the diagonal rib is arranged diagonally with respect to the third center rib.

22. The railroad car truck bolster of claim 20, which includes a second diagonal rib, the third center rib being between the first diagonal rib and the second diagonal rib.

23. The railroad car truck bolster of claim 20, wherein the top member is connected to at least one of the first center rib, the second center rib, the third center rib, and the diagonal rib.

24. The railroad car truck bolster of claim 20, wherein the first U transition includes a first curved shoulder and a second curved shoulder, the first center rib extending from the from the first curved shoulder, the second center rib extending from the second curved shoulder.

25. The railroad car truck bolster of claim 20, wherein the first center rib, the second center rib, and the third center rib are substantially parallel.

26. The railroad car truck bolster of claim 20, wherein the thickened walls include respective curvatures that provide smooth transition between inner and outer surfaces of the thickened walls that define the brake rod holes.

27. The railroad car truck bolster of claim 20, which includes a first vertical or substantially vertical rib positioned adjacent to one of the brake rod holes.

28. The railroad car truck bolster of claim 20, wherein the first vertical or substantially vertical rib extends downwardly from the top member.

* * * * *